US008695543B2

(12) United States Patent
Adam et al.

(10) Patent No.: US 8,695,543 B2
(45) Date of Patent: Apr. 15, 2014

(54) INTERNAL COMBUSTION ENGINE COOLING UNIT

(75) Inventors: Guillaume Adam, Paris (FR); Christophe Aymard, Le Vaudreuil (FR); Vincent Desfeux, Vieux-Villez (FR); Benoit Janier, Chaville (FR); Pascual Lopez Oliva, Valladolid (ES)

(73) Assignee: Renault S.A.S., Boulogne-Billancourt (FR)

( * ) Notice: Subject to any disclaimer, the term of this patent is extended or adjusted under 35 U.S.C. 154(b) by 513 days.

(21) Appl. No.: 12/598,640

(22) PCT Filed: Apr. 25, 2008 (Under 37 CFR 1.47)

(86) PCT No.: PCT/FR2008/050755

§ 371 (c)(1), (2), (4) Date: Jul. 8, 2010

(87) PCT Pub. No.: WO2008/155492

PCT Pub. Date: Dec. 24, 2008

(65) Prior Publication Data

US 2011/0174243 A1 Jul. 21, 2011

(30) Foreign Application Priority Data

May 3, 2007 (FR) ..... 07 03198

(51) Int. Cl.
*F01P 7/14* (2006.01)
*F01P 3/20* (2006.01)

(52) U.S. Cl.
USPC ..... 123/41.51; 123/41.29; 123/25 Q; 123/41.01; 123/41.31; 123/41.09

(58) Field of Classification Search
USPC ..... 123/25 Q, 41.01, 41.51, 41.29
See application file for complete search history.

(56) References Cited

U.S. PATENT DOCUMENTS

| | | | | |
|---|---|---|---|---|
| 3,439,657 | A * | 4/1969 | Gratzmuller | 123/563 |
| 4,049,047 | A * | 9/1977 | Keen | 165/104.31 |
| 4,180,032 | A * | 12/1979 | Plegat | 123/563 |
| 4,829,939 | A * | 5/1989 | Veenemans et al. | 123/41.29 |
| 5,255,636 | A * | 10/1993 | Evans | 123/41.54 |
| 6,032,869 | A * | 3/2000 | Ito et al. | 237/12.3 B |
| 6,158,398 | A * | 12/2000 | Betz | 123/41.29 |
| 6,595,433 | B2 * | 7/2003 | Ap et al. | 237/12.3 B |

(Continued)

FOREIGN PATENT DOCUMENTS

| | | |
|---|---|---|
| DE | 19633190 | 2/1998 |
| EP | 0 271 136 | 6/1988 |

(Continued)

*Primary Examiner* — Lindsay Low
*Assistant Examiner* — Kevin Lathers
(74) *Attorney, Agent, or Firm* — Oblon, Spivak, McClelland, Maier & Neustadt, L.L.P.

(57) ABSTRACT

A unit for cooling an internal combustion engine, including: a crankcase exchanger configured to allow for a flow of a crankcase coolant, a main radiator, an additional radiator, and a cooling circuit configured to convey the coolant between the exchanger of the crankcase and the radiators. The unit includes a burnt gas exchanger including a burnt gas pipe and a coolant pipe, the burnt gas exchanger configured to convey the coolant and to perform a heat exchange between the burnt gases and the coolant. In addition, the cooling circuit is configured to convey the coolant between the burnt gas exchanger and the main and additional radiators.

17 Claims, 2 Drawing Sheets

(56) References Cited

U.S. PATENT DOCUMENTS

| | | | | |
|---|---|---|---|---|
| 6,612,272 | B2 * | 9/2003 | Kato et al. | 123/41.82 R |
| 7,168,398 | B2 * | 1/2007 | Ap et al. | 123/41.1 |
| 2003/0047171 | A1 * | 3/2003 | Vaughan et al. | 123/568.12 |
| 2003/0205360 | A1 * | 11/2003 | Larson | 165/43 |
| 2005/0000473 | A1 | 1/2005 | Ap et al. | |
| 2006/0213463 | A1 | 9/2006 | Wikstrom | |
| 2007/0199320 | A1 * | 8/2007 | Yager et al. | 60/599 |

FOREIGN PATENT DOCUMENTS

| | | |
|---|---|---|
| FR | 2884864 | 10/2006 |
| FR | 2890697 | 3/2007 |
| WO | 03042515 | 5/2003 |
| WO | 2004 085807 | 10/2004 |

* cited by examiner

INTERNAL COMBUSTION ENGINE COOLING UNIT

BACKGROUND

The present invention relates in general to the field of combustion engine cooling.

More specifically, the invention relates to a unit for cooling an internal combustion engine, the unit comprising:

- a crankcase exchanger designed to allow the circulation of a heat transfer fluid for cooling a crankcase;
- a main radiator;
- an additional radiator;
- a cooling circuit designed to carry the heat-transfer fluid between the crankcase exchanger and the radiators.

To cool engines use is made of an exchanger intended to collect heat energy from a region of the engine that is to be cooled and this heat energy is carried to one or more radiators.

This is why numerous combustion engine manufacturers have developed various solutions aimed at cooling engines.

An engine cooling unit of the type defined hereinabove is described, for example, in French patent document FR2884865 which discloses a unit provided with a main radiator and with an additional radiator too enabling the cooling capacity of the main radiator to be increased when the additional radiator is in operation.

BRIEF SUMMARY

In this context, it is an object of the present invention to propose an engine cooling unit that allows the use of the radiators to be modified while the engine is running to suit the specific engine cooling requirements.

To this end, the cooling unit of the invention, in other respects consistent with the generic definition thereof given in the above preamble, is essentially characterized in that it comprises a burnt gases exchanger provided with a pipe carrying burnt gases and with a pipe for carrying heat transfer fluid, this burnt gases exchanger being designed to carry heat transfer fluid and perform an exchange of heat between burnt gases and the heat transfer fluid, and in that the cooling circuit is designed to carry heat transfer fluid between the burnt gases exchanger and said main and additional radiators.

In order to understand the invention it should be noted that the crankcase exchanger is preferably a cooling circuit created by a passage of heat transfer fluid through the crankcase.

Thanks to the invention, the cooling of the engine can be modified:

- in terms of the collection of heat energy because heat energy can be collected at various points in the engine, in this instance the crankcase and a region in which burnt gases circulate;
- in terms of the dissipation of the heat energy collected because this heat energy which is carried by one and the same cooling circuit can be dissipated via the main radiator and/or the additional radiator.

The main and additional radiators may be connected simultaneously to the crankcase exchangers and burnt gases exchangers via the cooling circuit, making it possible to combine the cooling capacities of the radiators if there is a desire to collect heat simultaneously from the burnt gases and from the crankcase.

In addition, thanks to the invention, the size of the main radiator can be reduced by comparison with what would have been needed had there been no additional radiator. This feature makes the main radiator easier to integrate into the vehicle especially given that it is easier to integrate two radiators of modest size into a vehicle than it is to integrate a single very large radiator.

The fact of using a main radiator of a modest size also means that its thermal inertia can be limited.

In order to understand the invention it should be noted that the burnt gases are the gases from the combustion of fuel originating from at least one combustion chamber of the engine. These burnt gases are generally discharged but may equally be admitted to the combustion chamber to influence engine operation. When they are, control over the temperature of the admitted burnt gases may have an impact on engine operation. Thus, the invention makes it possible to gain control over the temperature of the burnt gases that are to be injected into the combustion chamber. Ideally, the temperature of the burnt gases is measured or evaluated using a temperature probe positioned at the outlet of the burnt gases exchanger. This temperature probe can also be used to protect the unit of the invention against a risk of overheating.

Provision may also be made to ensure that the main radiator has a surface area for heat exchange that is greater than a surface area for heat exchange of the additional radiator and that the cooling circuit comprises actuators such as pumps and/or valves and is designed to selectively adopt a series configuration in which the radiators are connected in series and a parallel configuration in which the radiators are connected in parallel.

The switching of the cooling circuit from a series configuration to a parallel configuration takes place by operating at least one of said actuators.

When the cooling circuit is in the series configuration, all of the heat transfer fluid flowing through the main radiator also flows through the additional radiator. In this configuration, the surface area for heat exchange available for cooling the heat transfer fluid is at a maximum, encouraging engine cooling. By contrast, when the cooling circuit is in the parallel configuration, some of the heat transfer fluid flows through the main radiator and another separate proportion of the heat transfer fluid flows through the additional radiator. In this embodiment, it is possible to vary the cooling capacity offered by the cooling circuit by varying the proportion of heat transfer fluid passing through the main radiator and the proportion of fluid passing through the additional radiator. This embodiment therefore makes it possible to use each radiator in accordance with its actual ability to remove the heat from the heat transfer fluid and according to the actual engine cooling requirements.

This embodiment also makes it possible to increase the flow of heat transfer fluid through the crankcase exchanger, thus promoting engine block cooling.

The fact that the invention makes it possible to switch from a series configuration to a parallel configuration simply by operating the actuators is a particular advantage because it thus is possible at any moment to choose which configuration is best suited to the operation of the unit and of the engine.

The invention also relates to a method for regulating the internal combustion engine cooling unit. According to this method of the invention at least one temperature of a component of said cooling unit is measured and provision is made to ensure that:

- when the measured temperature is below a predetermined low temperature level the unit is instructed to adopt a configuration in which one and the same stream of heat transfer fluid flows through the main and additional radiators and through the burnt gases exchanger; and
- when this measured temperature is above a predetermined high temperature level, the unit is instructed to adopt a configuration in which a stream of heat transfer fluid flows through the crankcase exchanger and is then split into two fluid substreams;

one of these fluid substreams flowing through the main radiator without passing through the additional radiator; and the other of these fluid substreams flowing through the additional radiator without passing through the main radiator.

The temperature of the component of said cooling unit is generally measured on a component located near the crankcase and/or near the crankcase exchanger, so that the measured temperature is representative of a temperature in the engine block to which the crankcase belongs. To that, provision may be made to ensure that the measured temperature is measured by a thermostat positioned at the outlet of the crankcase exchanger. A thermostat such as this is described hereinafter as being positioned in such a way as to regulate the flow of heat transfer fluid passing between the crankcase exchanger and the main and additional radiators. In the latter instance, it is the thermostat which controls the unit and causes it to adopt one or other of the configurations.

According to this method, when the measured temperature is low, that is to say below the predetermined low temperature level, provision is made to ensure that the burnt gases are cooled by connecting the burnt gases exchanger through which the recirculated gases flow in series with the main and additional radiators. This results in a reduction in pollutant emissions from the engine.

The cooling of the engine block is thus reduced so that it can gain temperature more rapidly.

Alternatively, when the measured temperature is high, that is to say above the predetermined high temperature level, provision is made to ensure that the heat transfer fluid flows through the crankcase exchanger before passing through the main and additional radiators, thus allowing the engine block to be cooled, and preventing any degradation of the engine oil through overheating, something which is advantageous from a consumption point of view. In the latter configuration, the main and additional radiators are no longer connected in series but are connected in parallel.

In a preferred embodiment of the invention, when the measured temperature is below the predetermined low temperature level, provision is made to ensure that said same stream of heat transfer fluid which flows through the main and additional radiators and through the burnt gases exchanger does not flow through the engine exchanger.

This embodiment encourages the heating-up of the crankcase when the engine block to which it belongs is cold, and this increases the efficiency of the engine and therefore reduces its fuel consumption on start-up.

It is also possible to make provision to ensure that the unit of the invention comprises actuators designed independently to modify each flow of heat transfer fluid flowing through each of the exchangers.

It is also possible to make provision to ensure that the cooling circuit comprises a so-called mechanical heat transfer fluid pump mounted in series with said crankcase exchanger to force heat transfer fluid to circulate therein.

This mechanical pump has a pump drive means engaged with a moving part of the engine and so the mechanical pump is mechanically actuated by the moving part of the engine and the flow of the heat transfer fluid it generates in the crankcase is proportionate to the engine speed.

It is also possible to make provision to ensure that the unit of the invention comprises an injector exchanger designed to allow heat transfer fluid to circulate around an engine fuel injector, the injector exchanger being connected to the cooling circuit in such a way as to allow heat transfer fluid to be carried between the injector exchanger and said main and additional radiators.

For an understanding of the invention it should be noted that the injector exchanger is preferably a cooling circuit created by a passage of heat transfer fluid through the body of the injector support.

This embodiment makes it possible to cool a fuel injector without having recourse to a radiator specific to this injector. The function of cooling a fuel injector is used mainly for a fuel injector positioned in the engine exhaust line, for injecting fuel thereinto directly toward a particulate filter.

It is also possible to make provision to ensure that the cooling unit of the invention comprises a turbocharger exchanger designed to allow heat transfer fluid to circulate around at least part of an engine turbocharger, the turbocharger exchanger being connected to the cooling circuit in such a way as to allow heat transfer fluid to be carried between the turbocharger exchanger and said main and additional radiators.

For an understanding of the invention, it should be noted that the turbocharger exchanger is preferably a cooling circuit created by a passage of heat transfer fluid through the turbocharger casing.

This embodiment makes it possible to cool part of the turbocharger without having to resort to a radiator specific to the turbocharger.

It is also possible to make provision to ensure that the unit of the invention comprises a unit heater connected to the cooling circuit in such a way as to allow heat transfer fluid to be carried between the unit heater and said exchangers.

It is also possible to make provision to ensure that the cooling circuit is designed to adopt a configuration in which all of the exchangers are hydraulically connected to said main and additional radiators.

It is also possible to make provision to ensure that the unit of the invention comprises a primary electric pump connected directly in series to the turbocharger exchanger so as to force heat transfer fluid to circulate between the turbocharger exchanger and said main and additional radiators.

The term connected directly defines a connection made by a line that has no branch-offs between the objects connected. Thus, the direct connection between the primary electric pump and the exchanger is made by a line that has no branch-offs.

This electric pump makes it possible to force heat transfer fluid to circulate irrespective of the engine speed, unlike the flow driven by the mechanical pump which is in proportion to the engine speed. This electric pump may thus be used even when the engine is not running.

Provision may also be made to ensure that the unit of the invention comprises an additional electric pump connected directly and in series to the additional radiator so as to force heat transfer fluid to circulate therein.

This embodiment allows the heat transfer fluid to flow in the additional radiator when the engine is not running. This embodiment may also be used when the main and additional radiators are mounted in parallel, in which case the fact that there is an additional pump connected directly and in series with the additional radiator makes it possible to control the proportion of fluid from the cooling circuit which passes through the additional radiator. Specifically, the greater the flow forced by the additional pump, the greater the proportion of fluid passing through the additional radiator by comparison with the proportion passing through the main radiator.

It is also possible to make provision to ensure that the cooling circuit comprises a heat collecting portion to which the various exchangers are connected and a cooling portion to which the various radiators are connected, these collecting and cooling portions being connected to one another by a supply line connecting a fluid outlet of the crankcase exchanger to inlets of the main and additional radiators and by a return line connecting outlets of the main and additional radiators to a fluid inlet of the crankcase exchanger, the unit further comprising a thermostat positioned on the supply line so as to regulate the flow of the heat transfer fluid passing between the crankcase exchanger and the main and additional radiators as a function of the temperature of this fluid.

This thermostat is designed to regulate the flow of the heat transfer fluid passing between the crankcase exchanger and the main and additional radiators as a function of the temperature of this fluid.

The return line allows the heat transfer fluid to return to the mechanical pump after this fluid has passed through one and/or other of the main/additional radiators. This return line is such that all of the heat transfer fluid passing through the radiators can be returned to the crankcase exchanger along this single return line.

Other features and advantages of the invention will become clearly apparent from the description thereof given hereinafter by way of entirely nonlimiting indication with reference to the attached drawings in which:

DETAILED DESCRIPTION

Figure 1:
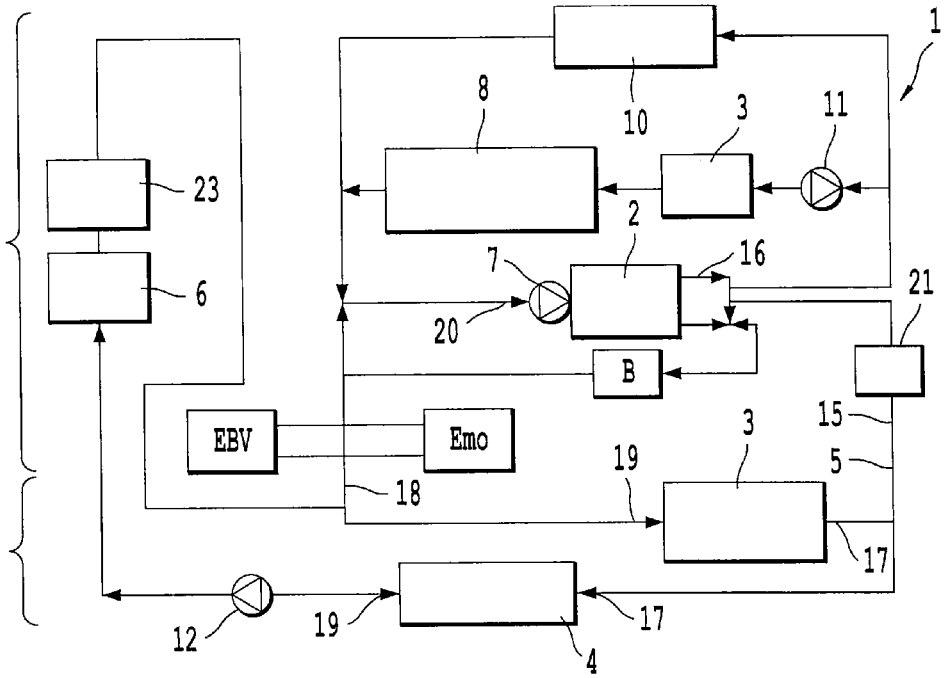
FIG. 1 represents a hydraulic diagram of a first embodiment of the unit of the invention.

As mentioned previously, the invention relates to an internal combustion engine cooling unit.

According to the first and second embodiments set out in FIGS. 1 to 4, the unit of the invention comprises several exchangers designed to collect heat from various constituent parts of the engine and to transfer this collected heat using a heat transfer fluid.

In this particular instance, the crankcase exchanger 2 is formed of a passage in the crankcase to cool the latter.

The burnt gases exchanger 6 is designed to collect heat from the burnt gases flowing, in this instance, via a circuit for readmitting burnt gases to the combustion chambers of the engine. This exchanger thus allows better control over the temperature of the recirculated burnt gases.

The injector exchanger 8 is positioned around a fuel injector placed in the exhaust, this exchanger, which is preferably a duct made in the injector support having the purpose of preventing the injector from overheating as a result of the circulation of burnt gases near the injector.

The turbocharger exchanger 9 is designed to collect heat from the turbocharger and thus prevent damage thereto.

Still with reference to FIGS. 1 to 4, the unit of the invention also comprises main 3 and additional 4 radiators and a unit heater 10 which are connected to a cooling circuit 5 to which said exchangers are coupled.

The radiators 3, 4 and the unit heater 10 are arranged in such a way as to remove heat from the heat transfer fluid carried through the cooling circuit 5.

A mechanical pump 7 is positioned in series with an inlet 20 of the crankcase exchanger 2 in order to force the heat transfer fluid of the cooling circuit 5 thereinto. This mechanical pump 7 is mechanically driven by the turning-over of the combustion engine.

A primary electric pump 11 is also connected in series with the turbocharger exchanger 9 in order to force heat transfer fluid carried by the cooling circuit 5 thereinto.

Figure 2:
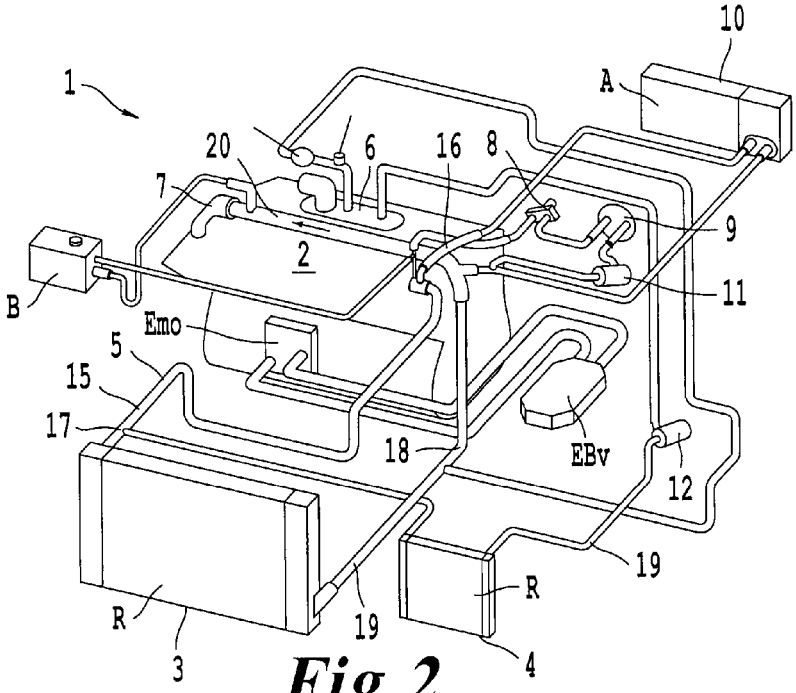
FIG. 2 represent a three-dimensional view of a combustion engine equipped with the cooling unit of FIG. 1.

With reference to the single embodiment of FIGS. 1 and 2, an additional electric pump 12 is connected in series with the burnt gases exchanger in order to force heat transfer fluid carried by the cooling circuit 5 to circulate therein.

Figure 3:
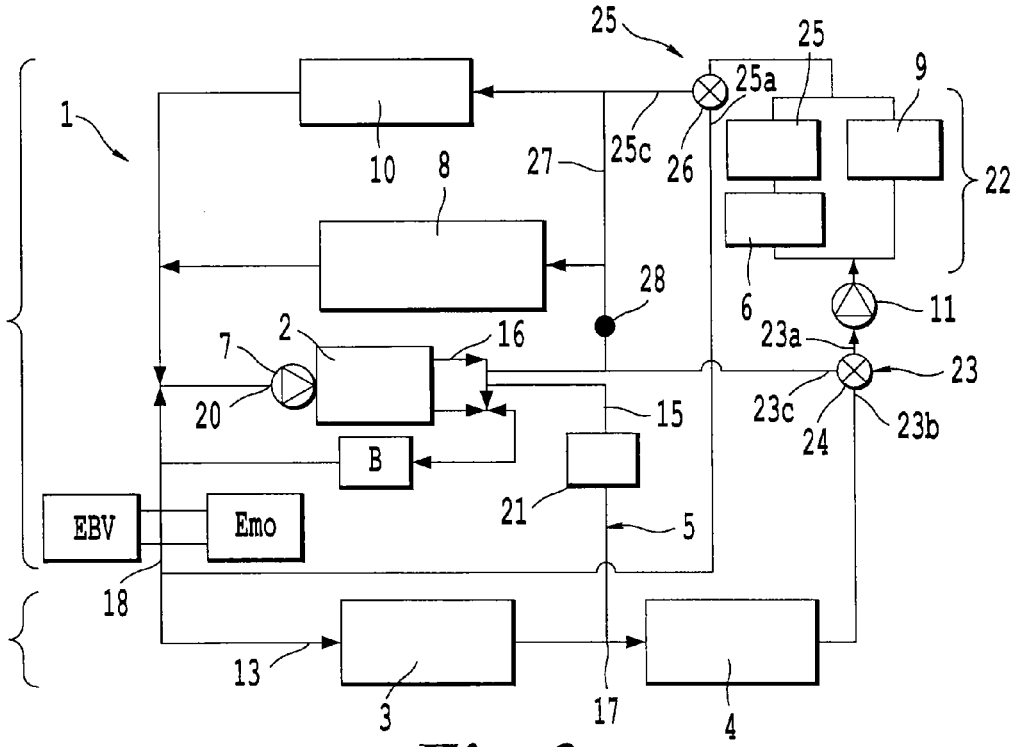
FIG. 3 represents a hydraulic diagram of a second embodiment of the unit of the invention.
Figure 4:
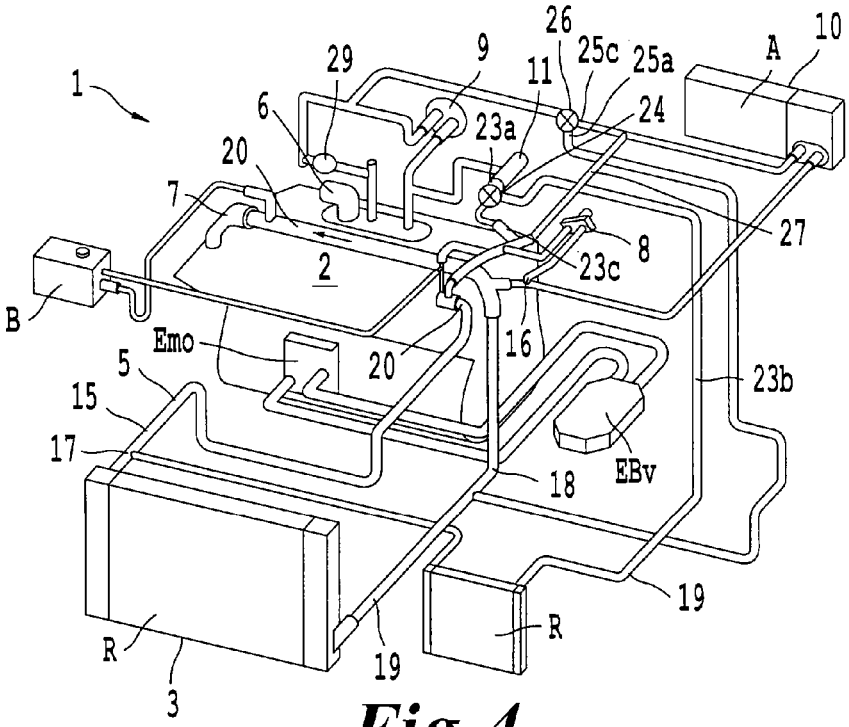
FIG. 4 represents a three-dimensional view of a combustion engine equipped with the cooling unit of FIG. 3.

It should be noted that the additional electric pump 12 may be replaced by one single solitary primary pump if the turbocharger and burnt gases exchangers are mounted in parallel with one another and are each connected to the primary pump as is the case in FIGS. 3 and 4.

In either of the embodiments of the invention, each of the electric pumps 11 and 12 is chosen to allow the heat transfer fluid to pass freely through the electric pump when the pump is not operating.

A thermostat visible in FIGS. 1 to 4 is positioned on a supply line 15 connecting the crankcase exchanger 2 to the radiators 3 and 4. The function of this thermostat 21 is to control the flow of the heat transfer fluid passing from the crankcase exchanger 2 to the radiators 3, 4 via the supply line 15. This flow is controlled by the thermostat 21 as a function of the temperature of the fluid heated by the crankcase exchanger 2. Thus, the heat transfer fluid from the crankcase exchanger 2 passes toward the radiators only when the temperature is above the predetermined threshold generally equal to 90° C.

The unit of the invention in FIGS. 1 to 4 also comprises an expansion vessel B intended to maintain a minimum heat transfer fluid pressure in the whole of the cooling circuit 5.

The unit of the invention also comprises a gearbox exchanger EBV connected to the cooling circuit in order therein to remove the heat produced by a gearbox of the engine, and an engine oil exchanger EMO connected to the cooling circuit 5 in order therein to remove the heat produced in the engine sump.

A valve exchanger 29 may also be used to dissipate the heat produced at the valve 29 which is the valve which either permits or prevents burnt gases from passing to the combustion chambers of the engine.

This valve exchanger is preferably created by a passage in the body of the valve 29 so that a heat transfer fluid can circulate therein.

These last two valve (EBV) and EMO exchangers are arranged in parallel with the return line 18 that returns the heat transfer fluid that has passed through at least one of the radiators.

This return line 18 is connected to one inlet 20 of the crankcase exchanger 2 to return the cooled fluid.

The expansion vessel B has a high fluid inlet which is connected to the outlet 16 of the crankcase exchanger 2 and a low outlet connected to the return line 18 at the mechanical pump 7. This arrangement of the expansion vessel B makes it possible to ensure that the circuit 5 is always supplied with heat transfer fluid that is free of air bubbles, improving the overall efficiency of the cooling circuit.

The unit heater 10 which is positioned in the cabin of the vehicle in order to heat it is, for its part, connected firstly to the outlet 16 of the crankcase exchanger 2 either directly via a line (as depicted in FIGS. 1 and 2) or via a line provided with a nozzle (as depicted in FIGS. 3 and 4) and secondly to the inlet 20 of the crankcase exchanger 2, by the mechanical pump 7.

Likewise, the additional injector exchanger 8 is connected firstly to the outlet 16 of the crankcase exchanger 2:

- either via the turbocharger exchanger 9 and the electric pump 11 as in FIGS. 1 and 2;
- or via a nozzle 28 as in FIGS. 3 and 4, and secondly to the inlet of the crankcase exchanger 2 via the mechanical pump 7.

In the particular embodiment of FIGS. 1 and 2, the turbocharger exchanger 9 is positioned in series with the injector exchanger 8 and the primary electric pump 11, these turbocharger 9 and injector 8 exchangers and the primary electric pump 11 thus forming a line one end of which is connected to the inlet of the crankcase exchanger 2 and the other end of which is connected to the outlet of the crankcase exchanger.

When the engine is running, the heat transfer fluid is pumped by the mechanical pump 7 from the inlet 20 to the outlet 16 of the crankcase exchanger 2 and has a tendency to flow through the line comprising the primary electric pump 11 starting from the end of the line that is connected to the outlet 16 toward the end of the line connected to the inlet 20.

The primary pump 11 is therefore switched off in order to allow the heat transfer fluid to flow freely through this line.

By contrast, when the engine is not running, the mechanical pump 7 is no longer driven by the engine and therefore does not operate, and the primary electric pump 11 is then electrically operated to force the heat transfer fluid to flow through the line in the opposite direction to the direction in which the fluid flows when the engine is running.

In order to perform this function of circulating heat transfer fluid through the injector exchanger 8 and/or the turbocharger exchanger 9, toward the unit heater 10 and/or toward the crankcase exchanger 2, provision is made to ensure that the primary pump 11 is positioned in such a way that the flow it generates is directed toward the outlet 16 of the crankcase exchanger and not toward the inlet 20 of the crankcase exchanger 2.

In this same embodiment, if the engine is hot and the thermostat 21 allows fluid to circulate, the primary pump 11 with therefore have a tendency to force the fluid to flow through the supply line 15 and through the main 3 and additional 4 radiators, thus increasing the engine cooling capacity even though the engine is still not running.

In this same embodiment of FIGS. 1 and 2, the main 3 and additional 4 radiators are mounted in parallel and have their respective inlets 17 connected to the thermostat of the supply line 15. The additional electric pump 12 is positioned between the outlet 19 of the additional radiator 4 and an inlet of the burnt gases exchanger 6. The burnt gases exchanger 6 is connected by its outlet to the fuel return line 18 and therefore to the outlet 19 of the main exchanger.

Thus, when the engine, whether or not it is running, is too hot, the thermostat allows heat transfer fluid to pass from the crankcase exchanger 2 to the inlets of the radiators 17 and the fluid therefore arrives at the injector 8 and crankcase 2 exchangers and at the unit heater 10 via the return line 18.

The secondary electric pump 12 is then actuated if there is a desire to accelerate the flow of heat transfer fluid passing through the additional radiator 4.

To permit this function, the additional electric pump 12 is oriented in such a way as to create a flow of heat transfer fluid through the additional radiator 4 from the supply line 15 toward the return line 18.

In general, when the thermostat is partially open, provision is made to ensure that the additional pump 12 is running because it creates a circulation of fluid in a loop between the additional radiator 4 and the burnt gases exchanger 6. In this instance, the direction of the flow of fluid in the main radiator 3 depends on the pressure difference created by the additional electric pump 12 and the mechanical pump 7.

When the engine is running but the thermostat is closed, that is to say under cold or start-up conditions, with a heat transfer fluid temperature of less than 90° at the location of the thermostat, provision is made to ensure that the additional electric pump 12 is running and that the primary electric pump 11 is not running. The cooling of the burnt gases is then important because the heat transfer fluid circulates in a loop through the main 3 and additional 4 radiators, the temperature of the fluid flowing through the burnt gases exchanger then being less than 50° C.

In all the operating scenarios for the unit of FIGS. 1 and 2 the primary electric pump 11 is always switched off when the engine is running and can be switched on only when the engine is not running.

If the flow rate in the additional radiator 4 is lower than the flow rate that the additional electric pump 12 can supply, it may be advantageous to switch this pump on in order to increase the flow rate through the additional radiator, but such a course of action could lead to a reduction in the flow rate through the main radiator.

The additional pump 12 may be controlled on the basis of a measured temperature and of a predetermined temperature threshold at which the pump is triggered.

An electronic control unit may be provided to do this. This unit may be designed to interrupt the operation of the additional pump 12 as soon as the measured temperature exceeds a predetermined pump cut-off temperature threshold. This feature makes it possible to ensure an optimum flow rate through the main radiator.

In the single embodiment of FIGS. 3 and 4, the burnt gases exchanger 6 and the turbocharger exchanger 9 are positioned on a secondary portion 22 of the cooling circuit 5 which portion is connected to the remainder of the cooling circuit 5 by a secondary portion inlet 23 fitted with a first three-way valve 24 and by a secondary portion outlet 25 fitted with a second three-way valve 26.

As a preference, in this embodiment in which the cooling unit 1 of the invention comprises such a secondary circuit portion 22, provision is made to ensure that an electric pump 11 is also positioned in series with the secondary portion 22 of the circuit, or directly on this secondary portion 22 between its inlet 23 and its outlet 25 so as to force the flow of heat transfer fluid through the secondary circuit portion 22 and especially through the burnt gases exchanger 6 and the turbocharger exchanger 9.

The three-way valve 24 at the inlet 23 to the secondary portion 22 has a tertiary route 23*c* connected to the outlet of heat transfer fluid 16 from the crankcase exchanger 2 between the thermostat 21 and this heat transfer fluid outlet 16 so as to allow the secondary portion 22 to be supplied with fluid that has been heated via the crankcase 2 without this fluid passing via the thermostat 21.

This three-way valve 24 at the inlet 23 to the secondary portion 22 has another route known as the secondary route 23*b* connected to the outlet of the radiator or radiators 3, 4, in this instance, to the outlet of the additional radiator 4.

This secondary route 23*b* of the three-way valve 24 is therefore connected to the heat transfer fluid outlet 16 from the crankcase exchanger 2 via the thermostat 21 positioned on the supply line 15 that connects the fluid outlet of the crankcase exchanger 2 to the inlets 17 of the main and additional radiators 3, 4.

The third and last route of the first three-way valve 24 is known as the primary route 23*a* and is connected to the inlets of the burnt gases 6 and turbocharger 9 exchangers in order to supply them either with fluid from the additional radiator when the thermostat is open and the temperature of the heat transfer fluid is great, or with fluid taken directly from the crankcase 2 when the thermostat is closed and the temperature of the heat transfer fluid is low.

The three-way valve 26 at the outlet 25 from the secondary portion 22 has a tertiary route 25*c* connected to the heat transfer fluid outlet 16 of the crankcase exchanger 2 via a connecting line 27 separate from the supply line 15 on which the thermostat 21 is positioned. This connection 27 comprises a nozzle 28 designed to limit the cross section of the connecting pipe 27 between the tertiary route 25*c* of the three-way valve 26 and the outlet of the crankcase exchanger 2.

The three-way valve 26 at the outlet 25 of the secondary portion 22 has a primary route 25*a* connected via a line to the return line 18 that connects the outlet from the main 3 and/or additional 4 radiator to a fluid inlet 20 of the crankcase exchanger 2.

The valves in the cooling unit of FIGS. 3 and 4 may be proportional or on/off valves.

When the engine of FIGS. 3 and 4 is running and the thermostat is closed because the fluid temperature is low (for example in extreme cold weather or when the temperature of the burnt gases is too low the second valve 26 is instructed to place the tertiary route 25*c* in communication with the turbocharger and burnt gases exchangers and the first three-way valve 24 is instructed to place the primary 23*a* and tertiary 23*c* routes in communication with one another. In this embodiment, the radiators are therefore bypassed by the fluid. The primary pump is in operation, the heat energy collected at the secondary portion 22 is transferred to the unit heater 10 to heat up the cabin of the vehicle and to the engine to accelerate its rise in temperature and therefore reduce its fuel consumption.

When the engine is running and the thermostat is closed but the burnt gases need to be cooled, the second three-way valve 26 is instructed to place the primary route 25*a* in communication with the burnt gases and turbocharger exchangers.

The first three-way valve 24 is instructed to place the primary 23*a* and secondary 23*b* routes in communication with each other. The primary electric pump 11 is then operating and the heat energy collected at the burnt gases exchanger, the valve exchanger 29 and the turbocharger exchanger 9 is then removed via the additional radiator 4. In this case, the direction of the flow through the main radiator depends on the pressure difference generated by the mechanical 7 and electrical 11 pumps.

When the engine is running with the thermostat 21 wide open (that is to say when the engine is hot), the engine cooling requirements are at a maximum and the requirements to cool the recirculated burnt gases are lower than in the previously mentioned operating scenarios. In this phase of operation, the second three-way valve is positioned in such a way that the primary route 25*a* is in communication with the burnt gases 6 and turbocharger 9 exchangers and the first valve 24 is positioned in such a way that the primary 23*a* and secondary 23*b* routes are in communication with one another. The heat energy collected via the exchangers 6, 9 and 29 of the secondary circuit portion is removed via the additional radiator 4. The primary electric pump 11 is switched on or off to optimize the desired cooling. If the primary pump 11 is not operating, the flow of heat transfer fluid is split between the two radiators 3 and 4, always passing through the additional radiator then through the burnt gases 6 and turbocharger 9 exchangers.

If the fluid flow rate in the additional radiator 4 is lower than the primary electric pump 11 would be able to produce, it may be advantageous to switch this pump on: this then increases the flow rate through the additional radiator 4 but carries the risk of slightly reducing the flow rate through the main radiator 3.

The primary pump 11 may be controlled as a function of the measured engine-temperature data. As soon as this measured temperature exceeds a predetermined temperature threshold, provision is then made to ensure that the operation of the primary pump 11 is interrupted in order to obtain a maximum fluid flow rate through the additional radiator 4.

Finally, when the engine is not running and the mechanical pump is not in operation, the primary pump is then switched on if the cooling of the turbocharger and possibly of other regions of the engine is to be continued.

If it is, then the second valve 26 is arranged in such a way that its tertiary route 25*c* is in communication with the burnt gases 6 and turbocharger 9 exchangers and the first valve 24 is arranged in such a way that the tertiary route 23 is in communication with the primary route 23*a*.

It should be noted that the embodiment of FIGS. 3 and 4 has the advantage of having just one electric pump by comparison with the embodiment of FIGS. 1 and 2 which has two electric pumps.

In each of the embodiments of FIGS. 1 to 4, provision is made to ensure that the various actuators that are the electric pumps and any valves there might be are operated using an electronic control unit which generates instructions for the actuators as a function of engine speed parameters and parameters concerned with the measured temperatures of various engine parts.

The invention claimed is:

1. A unit for cooling an internal combustion engine, the unit comprising:

a crankcase exchanger configured to allow circulation of a heat transfer fluid for cooling a crankcase;

a first pump at an inlet to the crankcase exchanger configured to force heat transfer fluid in a first direction into the inlet of the crankcase exchanger;

a main radiator;

a second pump downstream from the crankcase exchanger and upstream from the main radiator, the second pump being configured to force heat transfer fluid in a second direction toward an outlet of the crankcase exchanger;

an additional radiator;

a cooling circuit configured to carry the heat-transfer fluid between the crankcase exchanger and the radiators; and a burnt gases exchanger including a pipe for carrying burnt gases and with a pipe for carrying heat transfer fluid, the burnt gases exchanger configured to carry heat transfer fluid and perform an exchange of heat between burnt gases and the heat transfer fluid, and wherein the cooling circuit is configured to carry heat transfer fluid between the burnt gases exchanger and the main and additional radiators; and an expansion vessel with high fluid inlet connected to an outlet of the crankcase exchanger and a low outlet connected to the pipe for carrying heat transfer fluid at an inlet of the first pump, wherein the main radiator has a surface area for heat exchange that is greater than a surface area for heat exchange of the additional radiator, wherein the cooling circuit comprises actuators and is configured to selectively adopt a series configuration in which the radiators are fluidly connected in series or a parallel configuration in which the radiators are fluidly connected in parallel, and wherein in the parallel configuration a proportion of heat transfer fluid passing through the main radiator and a proportion of fluid passing through the additional radiator are regulated.

2. The unit as claimed in claim 1, wherein the the first pump is a mechanical heat transfer fluid pump mounted in series with the crankcase exchanger to force heat transfer fluid to circulate therein.

3. The unit as claimed in claim 1, further comprising an injector exchanger configured to allow heat transfer fluid to circulate around an engine fuel injector, the injector exchanger being connected to the cooling circuit to allow heat transfer fluid to be carried between the injector exchanger and the main and additional radiators.

4. The unit as claimed in claim 1, further comprising a turbocharger exchanger configured to allow heat transfer fluid to circulate around at least part of an engine turbocharger, the turbocharger exchanger being connected to the cooling circuit to allow heat transfer fluid to be carried between the turbocharger exchanger and the main and additional radiators.

5. The unit as claimed in claim 4, wherein the second pump is a primary electric pump connected directly in series to the turbocharger exchanger so as to force heat transfer fluid to circulate between the turbocharger exchanger and the main and additional radiators.

6. The unit as claimed in claim 5, further comprising an additional electric pump connected directly and in series to the additional radiator so as to force heat transfer fluid to circulate therein.

7. The unit as claimed in claim 1, further comprising a unit heater connected to the cooling circuit to allow heat transfer fluid to be carried between the unit heater and the burnt gases exchanger and the crankcase exchanger.

8. The unit as claimed in claim 1, wherein the cooling circuit is configured to adopt a configuration in which the burnt gases exchanger and the crankcase exchanger are hydraulically connected to the main and additional radiators.

9. The unit as claimed in claim 1, wherein the cooling circuit comprises a heat collecting portion connected to, the burnt gases exchanger and the crankcase exchanger, and a cooling portion to which the radiators are connected, the collecting and cooling portions being connected to one another by a supply line connecting a fluid outlet of the crankcase exchanger to inlets of the main and additional radiators and by a return line connecting outlets of the main and additional radiators to a fluid inlet of the crankcase exchanger, the unit further comprising a thermostat positioned on the supply line so as to regulate flow of heat transfer fluid passing between the crankcase exchanger and the main and additional radiators as a function of fluid temperature.

10. The unit as claimed in claim 1, further comprising an oil exchanger configured to circulate heat transfer fluid around an engine sump, the oil exchanger being connected to the cooling circuit to allow heat transfer fluid to be carried between the oil exchanger and the main and additional radiators.

11. The unit as claimed in claim 1, further comprising a gearbox exchanger configured to circulate heat transfer fluid around an engine gearbox, the gearbox exchanger being connected to the cooling circuit to allow heat transfer fluid to be carried between the gearbox exchanger and the main and additional radiators.

12. The unit as claimed in claim 1, further comprising a valve exchanger configured to circulate heat transfer fluid around a valve which controls the circulation of burnt gases, the valve exchanger being connected to the cooling circuit to allow heat transfer fluid to be carried between the valve exchanger and the main and additional radiators.

13. The unit as claimed in claim 1, wherein the first pump is a mechanical pump mechanically actuated by a moving part of the internal combustion engine and, wherein the mechanical pump generates a flow of heat transfer fluid in the crankcase exchanger proportionate to the speed of the moving part of the internal combustion engine.

14. A method of regulating a cooling unit of an internal combustion engine, comprising:

circulating, via a crankcase exchanger, a heat transfer fluid for cooling a crankcase;

forcing, via a first pump at inlet to the crankcase exchanger, the heat transfer fluid in a first direction into the inlet of the crankcase exchanger when the engine is running;

forcing, via a second pump positioned downstream from an outlet of the crankcase exchanger, the heat transfer fluid in a second direction toward the outlet of the crankcase exchanger when the engine is not running;

carrying, via a cooling circuit, the heat-transfer fluid between the crankcase exchanger and a main radiator and an additional radiator; and carrying, via a burnt gases exchanger including a pipe for carrying burnt gases and a pipe for carrying heat transfer fluid, the heat transfer fluid and performing an exchange of heat between burnt gases and the heat transfer fluid, wherein the cooling circuit is configured to carry heat transfer fluid between the burnt gases exchanger and the main and additional radiators, and wherein at least one temperature of a component of the cooling unit is measured and provision is made to ensure that:

when the measured temperature is below a predetermined low temperature level the cooling unit is instructed to adopt a configuration in which only one stream of heat transfer fluid flows through the main and additional radiators and through the burnt gases exchanger; and when the measured temperature is above a predetermined high temperature level, the unit is instructed to adopt a configuration in which a stream of heat transfer fluid flows through the crankcase exchanger and is then split into two fluid substreams;

a first fluid substream flows through the main radiator without passing through the additional radiator; and a second fluid substream flows through the additional radiator without passing through the main radiator, wherein an expansion vessel with high fluid inlet is connected to an outlet of the crankcase exchanger and a low outlet is connected to the pipe for carrying heat transfer fluid at an inlet of the first pump, and wherein a proportion of the first fluid substream and a proportion of the second fluid stream are regulated wherein the main radiator has a surface area for heat exchange that is greater than a surface area for heat exchange of the additional radiator, wherein the cooling circuit comprises actuators and is configured to selectively adopt a series configuration in which the radiators are fluidly connected in series or a parallel configuration in which the radiators are fluidly connected in parallel, and wherein in the parallel configuration a proportion of heat transfer fluid passing through the main radiator and a proportion of fluid passing through the additional radiator are regulated.

15. The method as claimed in claim 14, wherein when the measured temperature is below the predetermined low temperature level, provision is made to ensure that the one and only stream of heat transfer fluid that flows through the main and additional radiators and through the burnt gases exchanger does not flow through the crankcase exchanger.

16. The method as claimed in claim 14, wherein the second pump is not pumping the heat transfer fluid when the engine is running.

17. The method as claimed in claim 14, wherein the first pump is not pumping the heat transfer fluid when the engine is not running.

* * * * *